US006105217A

United States Patent [19]

Caradine et al.

[11] Patent Number: 6,105,217

[45] Date of Patent: Aug. 22, 2000

[54] BAG CLAMP

[76] Inventors: James Grant Caradine, 148 S. Nardo St., Solana Beach, Calif. 92075; Christopher I. Hall, 6550 Ponto Dr. No. 140, Carlsbad, Calif. 92009

[21] Appl. No.: 09/310,623

[22] Filed: May 12, 1999

[51] Int. Cl.[7] ..... A44B 21/00; B65D 37/00; B65D 77/10

[52] U.S. Cl. ..... 24/501; 24/30.5 R; 24/502; 24/543

[58] Field of Search ..... 24/501, 500, 502, 24/543, 30.5 R, 30.5 P

[56] References Cited

U.S. PATENT DOCUMENTS

| | | | |
|---|---|---|---|
| 381,265 | 4/1888 | Martens | 24/30.5 R |
| 405,518 | 6/1889 | Wilson | 24/30.5 R |
| 2,679,098 | 5/1954 | Diecken . | |
| 3,825,012 | 7/1974 | Nicoll | 24/543 |
| 4,356,600 | 11/1982 | Welch | 24/30.5 R |
| 4,360,970 | 11/1982 | Ostroski et al. | 30/2 |
| 4,394,791 | 7/1983 | Groth | 24/30.5 R |
| 4,428,098 | 1/1984 | Coker et al. | 24/30.5 R |
| 4,660,750 | 4/1987 | Blanchard | 24/501 |
| 4,711,031 | 12/1987 | Annello | 30/294 |
| 4,736,925 | 4/1988 | Kamstrup-Larsen et al. | 251/10 |
| 4,847,956 | 7/1989 | Levine | 24/30.5 R |
| 5,007,171 | 4/1991 | Horning, Jr. | 30/294 B |
| 5,305,500 | 4/1994 | Tucker | 24/30.5 R |
| 5,318,292 | 6/1994 | De Marco | 273/32 |
| 5,428,871 | 7/1995 | Iosif | 24/30.5 R |
| 5,457,858 | 10/1995 | Lin | 24/511 |
| 5,752,319 | 5/1998 | Su et al. | 30/361 |
| 5,802,677 | 9/1998 | Dorman et al. | 24/30.5 R |

FOREIGN PATENT DOCUMENTS

| | | | |
|---|---|---|---|
| 0156779 | 10/1985 | European Pat. Off. | 24/30.5 R |

*Primary Examiner*—Victor N. Sakran
*Attorney, Agent, or Firm*—William Patrick Waters

[57] ABSTRACT

A clamp for closing polymer bags. The clamp includes a pair of clamp members movable between a closed and an opened condition, each one of the clamp members having a jaw for engagement of a bag. Each clamp member has an inner and an outer surface. A hinge attaches the clamp members while biasing the clamp members into a closed configuration. Gripping means are disposed on the inner surface of each one of the clamp members. The gripping means include opposed striations on the inner surface of each clamp member. In addition, a blade having a blunted top surface is disposed on the inner surface of one of the clamp members and an anvil is disposed opposite the blade. When the clamp is in a closed, bag sealing configuration, the blunted blade surface abuts the anvil as the blade and anvil cooperate in securing the bag within the clamp. The blade includes a cutting edge for opening a bag when the clamp is moved across the bag surface.

27 Claims, 2 Drawing Sheets

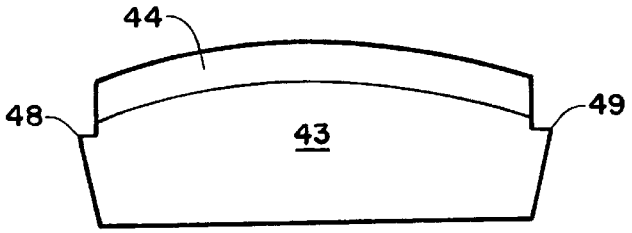
FIG. 9
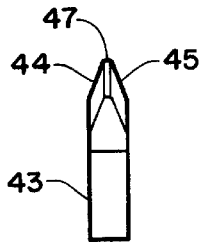
FIG. 10
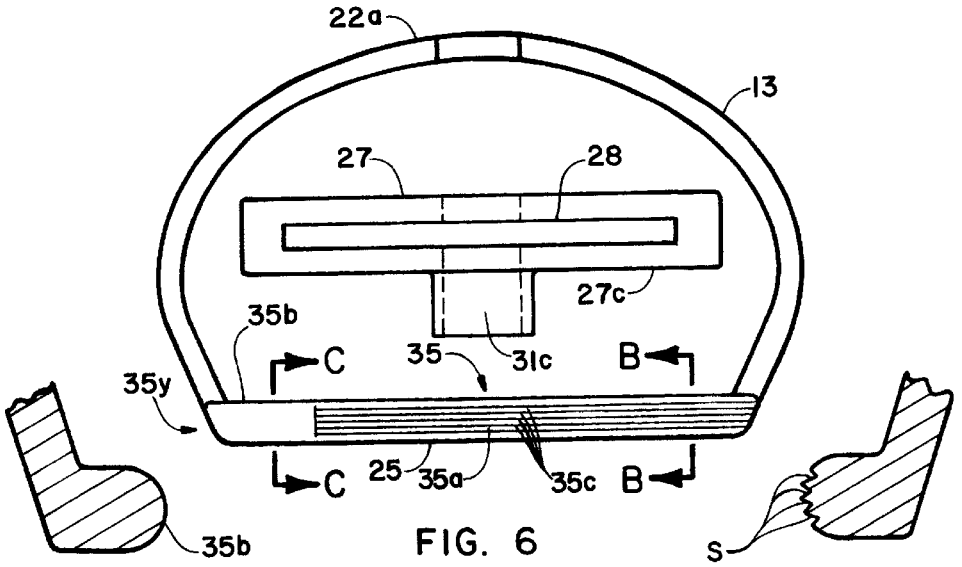
FIG. 6
FIG. 7
FIG. 8
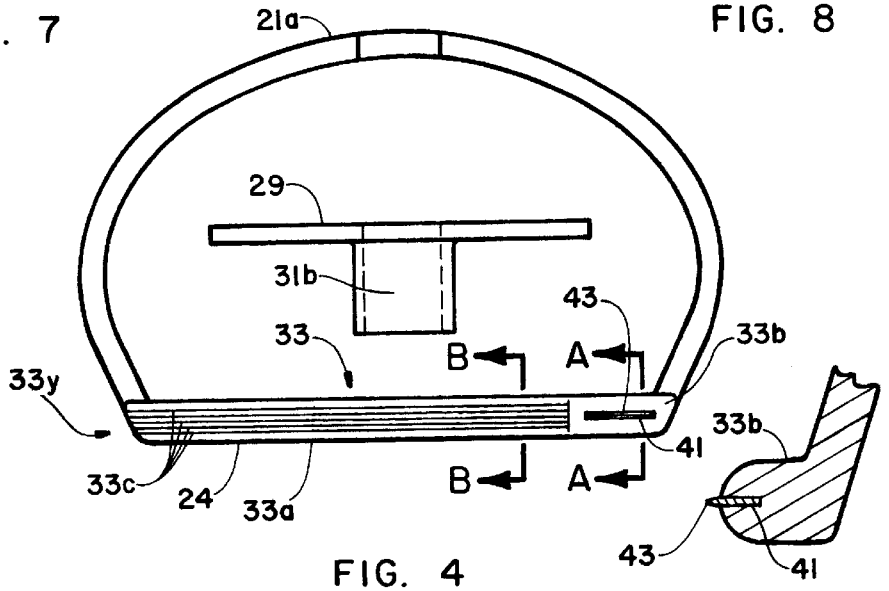
FIG. 4
FIG. 5

BAG CLAMP

BACKGROUND OF THE INVENTION

The present invention relates generally to closure devices and, more particularly, to clamps for closing bags containing foods, potting soil compositions and other materials.

A survey of the prior art reveals that a need exists for a device for closing securely modern polymer bags. These bags afford significant protection to their contents and are generally economical in use. As a result, they are used for a variety of products ranging from foods such as potato chips, in relatively small and light bags, to potting soil compositions which are sold in larger and heavier bags.

The bags are generally of polymer construction with polyproplyene and polyethelene compositions being favored in some cases. These compositions tend to produce a bag that is impervious to environmental conditions such as pests and moisture. However, the bags often have slippery surfaces. This challenges inventors of bag closure devices since an effective bag closure device should effectively reclose a polymer bag, in spite of the slippery nature of the bag surface. Thus, a suitable closure device should protect bag contents by providing effective sealing of the bag.

In many cases, the bags are intended for repetitive use wherein the bag is opened, some contents are removed, and the bag is reclosed. Generally, it is important that the bag be securely closed. In the case of foods such as potato chips, for example, after the bag has been opened and some chips removed, it is desirable to have a technique for closing the bag to preserve freshness of the product and to prevent ants or other pests from gaining access to the chips. Thus, it is desirable to have an effective, easily used polymer bag closing device.

When heavier polymer bags, containing potting soil, for example, are utilized, a sturdy bag closing device is required. Desirably, the closure device would be of a type that does not become dislodged easily. Conventional clamping devices sometimes fail this test because they concentrate gripping forces near the clamp center. Movement of the heavy bag results in slippage of the bag at the clamp edges with spillage of bag contents sometimes resulting. This is due, in part, to the weight of the bag which, together with a slippery texture, can cause the bag to tear free of the clamping device.

Several conventional devices have been used to close polymer bags. Such devices are utilized, not only for closing food containers but also as clamping devices for garments and the like. In this regard, reference may be made to U.S. Pat. Nos. 4,394,791; 4,356,600; 4,660,750; 5,007,171; 5,305,500; 5,318,292; 5,457,858 and 5,802,677. In general, these devices have some utility but can be complicated and at least in some cases, they tend to slip, especially when heavy bags, such as potting soil bags are involved.

Accordingly, there is a need for an efficient, low cost and effective device for sealing a modern polymer bag. Such a device could be adapted for small bags and large while affording a substantial amount of purchase against the slippery surface of the bag.

From the foregoing it will be apparent that there is a need for a polymer bag closure device that is reliable, effective, mechanically simple, easy to use and low in cost. In addition to these characteristics, it would be highly desirable if such a device could have utility in opening polymer bags in an effective manner.

Polymer bags are notoriously difficult to open. This is due, in part, to the strength of the synthetic material and effective sealing of the bag during the manufacturing process. The result is a bag which can be very difficult to open. In some typical cases, the user forcefully attempts to separate bag surfaces. This action can cause a rupture of the bag seal, destruction of the bag and spillage of bag contents.

Conventional opening devices often sometimes fail when applied to polymer bags. Thus, it would be highly desirable to have an effective polymer bag clamping device having the above described characteristics and that would be useful for opening such a bag in a convenient manner.

DISCLOSURE OF THE INVENTION

According to the present invention, there is provided a clamp for closing polymer bags. The clamp includes a pair of clamp members movable between a closed and an opened condition, each one of the clamp members having a jaw for engagement of a bag. Each clamp member has an inner and an outer surface. A hinge attaches the clamp members while biasing the clamp members into a closed configuration. Gripping means are disposed on the inner surface of each one of the clamp members. The gripping means include opposed striations on the inner surface of each clamp member. In addition, a blade having a blunted top surface is disposed on the inner surface of one of the clamp members and an anvil is disposed opposite the blade. When the clamp is in a closed, bag sealing configuration, the blunted blade surface abuts the anvil as the blade and anvil cooperate in securing the bag within the clamp. The blade includes a cutting edge for opening a bag when the clamp is moved across the bag surface.

The present invention affords several advantages. The combination of gripping surfaces on the clamp members provides a capacity for effective and efficient gripping of a polymer bag. Importantly, the blade and opposed anvil cooperate with the striated gripping surfaces to aid in distributing gripping forces away from the center of the clamp. Thus, a more efficient clamping capability is provided. In a preferred embodiment of the invention, the clamp is simple in construction and is comprised of readily available materials.

Other aspects and advantages of the present invention will become apparent from the following detailed description, taken in conjunction with the accompanying drawings, illustrating by way of example the principles of the invention.

BRIEF DESCRIPTION OF DRAWINGS

FIG. 4 is an isometric view of the inner surface of one of the clamp members of the present invention;

FIG. 5 is view taken along A—A of FIG. 4;

FIG. 6 is an isometric view of the inner surface of another one of the clamp members of the present invention;

FIG. 7 is a view taken along C—C of FIG. 6;

FIG. 8 is a view taken along B—B of FIGS. 4 and 6;

FIG. 9 is an isometric view of the blade utilized in the present invention; and FIG. 10 is a side perspective view of the blade shown in FIG. 9.

BEST MODE FOR CARRYING OUT THE INVENTION

Figure 1:
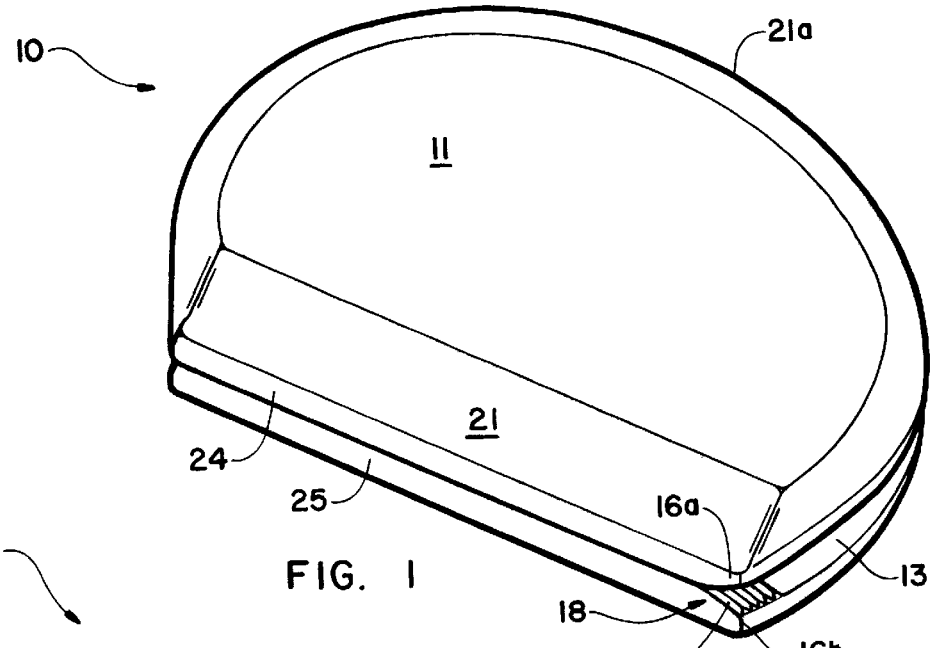
FIG. 1 is a front perspective view of a bag clamp which is constructed according to the present invention showing the clamp in a closed configuration.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

In the following detailed description and in the several figures of the drawings, like elements are identified with like reference numerals.

Figure 2:
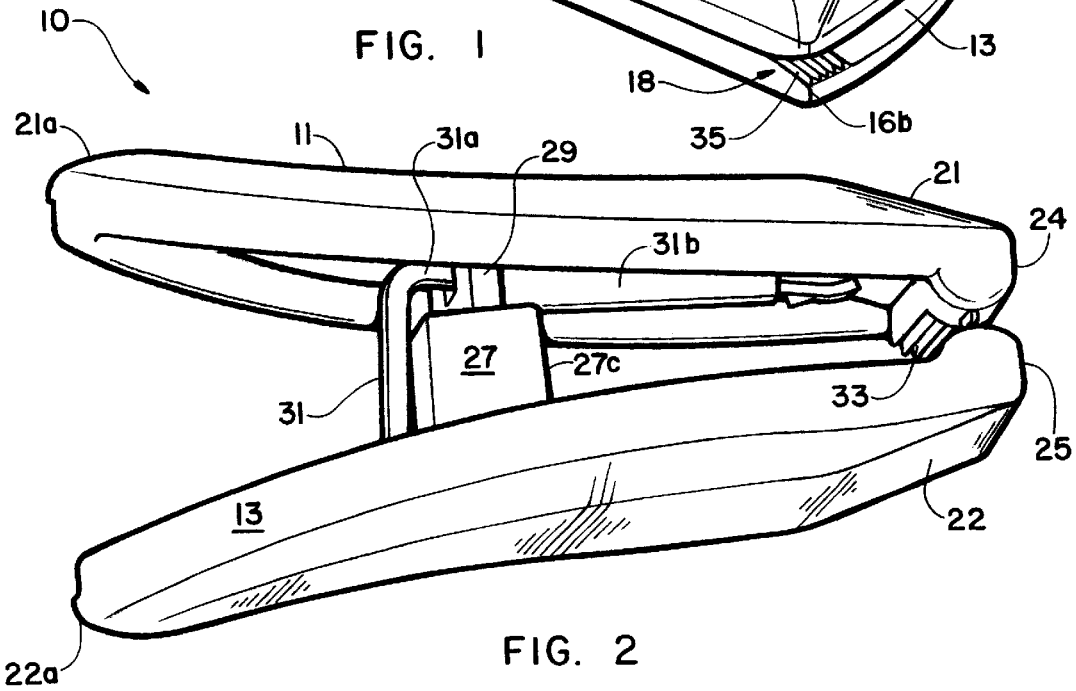
FIG. 2 is a right side perspective view of the present invention.
Figure 3:
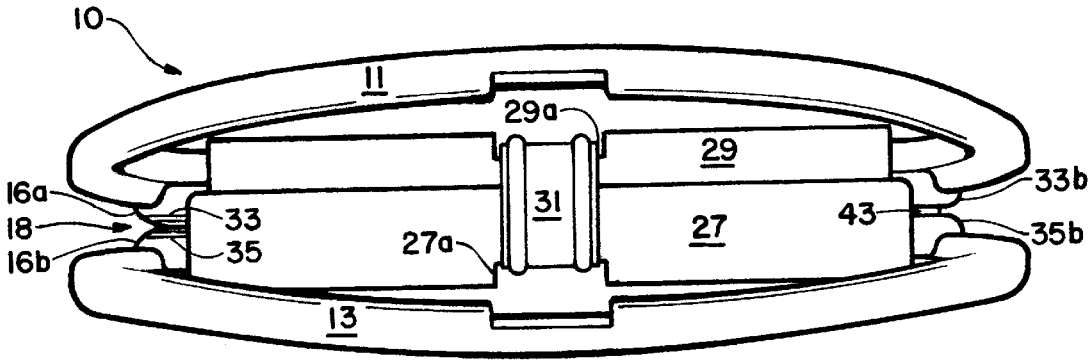
FIG. 3 is a rear perspective view of the present invention.

As shown in the drawings for purposes of illustration, the invention is embodied in a novel clamp 10 for closing a modern polymer bag. As shown in FIGS. 1–10, the clamp 10 includes an upper clamp member 11 and a lower clamp member 13 which define a bag receiving opening 18. The members each includes a lip, such as the lips 16*a* and 16*b*, respectively, for aiding in guiding a polymer bag into the clamp 10 for either opening or reclosing the bag.

The clamp members 11 and 13 each include a first portion 21 and 22, respectively, for engagement of a polymer bag surface. The first portions end, respectively, in generally straight leading edges 24 and 25. Opposite the first portions 21 and 22, the clamp members include a second portion 21*a* and 22*a*, respectively. The second portions 21*a* and 22*a* have a generally arcuate shaped edge. The arcuate shape enables easy grasping by a user for installing, or removing the clamp 10 from a polymer bag or for use of the clamp 10 as a bag opening tool.

An open, box-like structure 29, having a slot 28, is disposed on the inner surface of the clamp member 13. An elongated member 29, fixed to the inner surface of the clamp member 11, is received in the slot 28 for rotational movement therewithin. The elongated member 29 and the structure 27 each includes indents 27*a* and 29*a*. A spring clip 31 joins the clamp members 11 and 13 together and biases the leading edges 24 and 25 together. The spring clip 31 includes a pair of legs, such as the leg 31*a*, which is inserted through the indent 29*a* to be retained in a sleeve 31*b*. A second spring clip leg (not shown) is inserted through the indent 29*a* to be retained in a sleeve 31*c*.

Gripping elements, generally indicated by the reference numeral 33 for the clamp member 11, and by the reference numeral 35 for the clamp member 13, provide an effective technique for reclosing, and for opening, a polymer bag (not shown). As best shown in FIGS. 4, 5, and 8, the gripping elements 33 include a curved structure 33*y* disposed parallel to and adjacent the leading edge 24 of the clamp member 11. The structure 33*y* includes a portion 33*a* having a plurality of striations, such as the striations 33*c*, formed therein. The striations 33*c* are shown in FIG. 4 and are shown also in FIG. 8 where they are indicated generally by the reference letter S.

As shown in FIGS. 4 and 5, the structure 33*y* further includes a second curved portion 33*b*. A slot 41 is formed in the portion 33*b*. As part of the manufacture of the clamp 10, a blade 43 is snap fitted into the slot 41.

The gripping elements 35, located on the inner surface of the clamp member 13, cooperate with the gripping elements 33 during bag reclosure and bag opening operations.

In some respects, the clamp member 13 is similar in structure to the member 11. As best shown in FIGS. 6, 7, and 8, the gripping elements 35 include a curved structure 35*y* disposed parallel to and adjacent the leading edge 25 of the clamp member 13. The structure 35*y* includes a portion 35*a* having a plurality of striations, such as the striations 35*c*, formed therein. The striations 35*c* are shown in FIG. 6 and are shown also in FIG. 8 where they are indicated generally by the reference letter S. As shown in FIGS. 6 and 7, the structure 35*y* further includes a curved anvil 35*b*.

Referring now to FIGS. 9 and 10, the blade 43 will be considered. The blade includes a pair of oppositely disposed wings 48 and 49 which serve to hold the blade 43 within the slot 41. Tapered cutting edges 44 and 45 are oppositely located on the sides of the blade 43 while the blade includes a blunted top surface 47.

The operations of the clamp 10 in bag reclosing and bag opening will now be considered. For reclosing a bag, the user grasps the clamp 10 and squeezes together the portions 21*a* and 22*a* of the clamp members 11 and 13, respectively. The bag is then inserted into the clamp 10 until it touches a sidewall 27*c* of the structure 27. The side walls 27*c* functions as a fence in limiting the distance the bag material travels into the clamp 10. When it is determined that the bag is suitably installed, the clamp members 11 and 13 are released. At this time, the blunted top surface 47 of the blade 43 urges bag material against the anvil 35*b* thereby to hold the clamp 10 and the bag in proper orientation to each other. Simultaneously, the striations 33*a* and 35*a*, formed in the portions 33 and 35, compress the bag material and help hold the bag in place.

The polymer bag can be released quickly from the clamp 10 by the act of squeezing together the clamp member portions 21*a* and 22*a* while simultaneously removing the bag. While the blade 43 serves to secure the bag within the clamp 10, the blunted top surface 47 of the blade enables the bag to be held without any cutting of bag material.

When it is appropriate to open a polymer bag, the user grasps the clamp 10 and squeezes together the portions 21*a* and 22*a* of the clamp members 11 and 13, respectively. At the same time, the bag is inserted between the lips 16*a* and 16*b* and slid into the clamp 10. The insertion process is aided by the sidewall 27*c* which functions as a fence in guiding the bag material into the clamp 10. The clamp members 11 and 13 are released so as to move into a closed condition. At this point, the blunted top surface 47 of the blade 43 abuts the anvil 35*b*. When the bag material contacts the blade 43, the clamp 10 is drawn across the bag surface so that the cutting edge 44 of the blade 43 cuts through the bag material. When it is determined that a suitable cut has been made, the user releases the clamp members 11 and 13 so that the opened bag can be released from the device 10.

It will be evident that there are additional embodiments and applications which are not disclosed in the detailed description but which clearly fall within the scope of the present invention. The specification is, therefore, intended not to be limiting, and the scope of the invention is to be limited only by the following claims.

What is claimed is:

1. A clamp for closing a polymer bag, comprising:

a pair of opposed clamp members wherein said clamp members are movable between a closed and an opened condition, each one of said pair of clamp members having an inner and an outer surface;

a hinge attaching said pair of clamp members, said hinge biasing each one of said pair of clamp members into a closed condition; and means disposed on the inner surface of each one of said clamp members for gripping said bag, said gripping means including a blade disposed on the inner surface of one of said pair of clamp members and an opposed anvil, wherein said anvil is disposed on the inner surface of the other one of said pair of clamp members, said anvil having a flat surface for opposing said blade, said gripping means further including a plurality of striations disposed on the inner surface of each one of said pair of clamp members.

2. The clamp according to claim 1, wherein each one of said pair of clamp members includes a first portion for engagement of a bag surface and a second portion for grasping by a user.

3. The clamp according to claim 2, wherein said clamp member second portions each includes an arcuate shaped edge.

4. The clamp according to claim 2, wherein said clamp member second portions are angled outwardly from one another.

5. The clamp according to claim 1, wherein said hinge is attached to each one of said pair of clamp members at a location between said first portion and said second portion.

6. The clamp according to claim 1, wherein each one of said pair of clamp members includes a lip for aiding in positioning said bag in said clamp.

7. A The clamp according to claim 1, including a fence for aiding in positioning said bag in said clamp.

8. The clamp according to claim 1, wherein said blade is disposed adjacent an end of one of said pair of clamp members.

9. The clamp according to claim 1, wherein each one of said clamp members is elongated, each having at least one straight edge.

10. The clamp according to claim 9, wherein each one of said pair of clamp members includes an elongated bearing surface, each one of said bearing surfaces having an axis parallel to the straight edge of its respective clamp member.

11. The clamp according to claim 9, wherein said blade is disposed parallel to the straight edge of one of said pair of clamp members.

12. The clamp according to claim 1, wherein said hinge has a generally U shape and is positioned against the inner surfaces of each one of said pair of clamp members.

13. The clamp according to claim 1, wherein said gripping means includes a blade receiving slot disposed on the inner surface of one of said pair of clamp members.

14. The clamp according to claim 13, wherein said blade includes means for engaging said blade receiving slot for securing said blade within said blade receiving slot.

15. The clamp according to claim 14, wherein said blade engaging means includes a pair of wings disposed on opposed edges of said blade wherein said wings enable said blade to be fitted into said slot for retention therewithin.

16. The clamp according to claim 1, wherein said blade includes a blunted top surface.

17. The clamp according to claim 1, wherein said blade includes a pair of tapered sides.

18. The clamp according to claim 1, wherein said plurality of striations are disposed on the inner surfaces of each one of said pair of clamp members, parallel to the straight edge of each one of said members.

19. A device for opening a polymer bag, comprising:

a pair of clamp members wherein said clamp members are movable between a closed and an opened condition, each one of said pair of clamp members having a lip for engagement of a bag surface, each one of said pair of clamp members further having an inner and an outer surface;

a hinge attaching said pair of clamp members, said hinge biasing each one of said pair of clamp members into a closed condition; and bag cutting means disposed on the inner surface of each one of said clamp members for cutting a bag, said cutting means including a blade fixedly attached to the inner surface of one of said pair of clamp members and an opposed anvil, wherein said anvil is disposed on the inner surface of the other one of said pair of clamp members and includes a flat surface for opposing said blade, whereby said blade abuts said anvil when said clamp members are moved to a closed condition, said blade including an edge for cutting said bag when said bag is drawn through said device.

20. The device according to claim 19, wherein said blade is disposed adjacent an end of one of said pair of clamp members.

21. The device according to claim 19, wherein said gripping means includes a blade receiving slot disposed on the inner surface of one of said pair of clamp members.

22. The device according to claim 19, wherein said blade includes a blunted top surface.

23. The device according to claim 19, wherein said blade includes a pair of tapered sides.

24. The device according to claim 19, wherein said blade includes means for engaging said blade receiving slot for securing said blade within said blade receiving slot.

25. The device according to claim 24, wherein said blade engaging means includes a pair of wings disposed on opposed edges of said blade wherein said wings enable said blade to be fitted into said slot for retention therewithin.

26. The device according to claim 19, wherein each one of said pair of clamp members includes a first portion for engagement of a bag surface and a second portion for grasping by a user.

27. The device according to claim 19, wherein said hinge is attached to each one of said pair of clamp members at a location between said first portion and said second portion.

* * * * *